United States Patent [19]

Neustat et al.

[11] Patent Number: 5,062,534

[45] Date of Patent: Nov. 5, 1991

[54] FABRIC SAMPLE DISPLAY

[75] Inventors: Paula Neustat; Larry Marchiony, both of New York, N.Y.

[73] Assignee: Burlington Industries, Inc., Greensboro, N.C.

[21] Appl. No.: 500,602

[22] Filed: Mar. 28, 1990

[51] Int. Cl.[5] ..... A47F 5/00

[52] U.S. Cl. ..... 211/48; 211/47; 211/96; 211/89

[58] Field of Search ..... 211/48, 81, 118, 96, 211/47, 45, 89; 160/335, 399, 402, 327

[56] References Cited

U.S. PATENT DOCUMENTS

| | | | |
|---|---|---|---|
| D. 263,901 | 4/1982 | Dassonville . | |
| De. 284,816 | 7/1986 | Howard . | |
| De. 288,641 | 3/1987 | Kester . | |
| 1,763,318 | 6/1930 | O'Brien | 211/96 X |
| 1,935,641 | 11/1933 | Kline | 211/47 |
| 2,023,866 | 12/1935 | Best | 211/48 |
| 2,136,168 | 11/1938 | Kern | 211/47 |
| 2,465,859 | 3/1949 | Fidler | 211/96 X |
| 2,786,579 | 3/1957 | Wright | 211/96 X |
| 2,926,824 | 3/1960 | St. Clair | 211/96 X |
| 2,975,904 | 3/1961 | Krebs et al. . | |
| 3,207,319 | 9/1965 | Best | 211/48 |
| 3,297,169 | 1/1967 | Schaefer . | |
| 3,333,711 | 8/1967 | Helmer et al. | 211/96 |
| 3,759,398 | 9/1973 | Romney | 211/48 X |
| 3,900,108 | 8/1975 | Rottermann et al. . | |
| 3,984,002 | 10/1976 | Howard . | |
| 4,049,125 | 9/1977 | Rochestie . | |
| 4,066,192 | 1/1978 | Wolf . | |
| 4,146,141 | 3/1979 | Winter et al. . | |
| 4,192,563 | 3/1980 | Levkovitch . | |
| 4,232,791 | 11/1980 | Howard . | |
| 4,361,241 | 11/1982 | Stoddard . | |
| 4,446,973 | 5/1984 | Fuller et al. . | |
| 4,548,328 | 10/1985 | Brauning . | |
| 4,682,697 | 7/1987 | Cohen . | |
| 4,697,710 | 10/1987 | Gradecki et al. . | |
| 4,759,480 | 7/1988 | Duester et al. . | |

FOREIGN PATENT DOCUMENTS

| | | |
|---|---|---|
| 3821999 | 6/1988 | Fed. Rep. of Germany . |
| 2419692 | 11/1979 | France . |
| 2441368 | 7/1980 | France . |
| 2468342 | 5/1981 | France . |
| 2587890 | 4/1987 | France . |
| 2110593 | 6/1983 | United Kingdom . |
| 125190 | 11/1984 | United Kingdom . |

*Primary Examiner*—Robert W. Gibson, Jr.
*Attorney, Agent, or Firm*—Nixon & Vanderhye

[57] ABSTRACT

A drapery fabric sample, or like fabric sample, is displayed in an effective yet simple manner. A drapery fabric sample having unpleated top, bottom, and sides edges is mounted in association with a cantilever arm. The arm is preferably a rectangular configuration plastic arm having a hinge pin at least one end, and a tab surface and side surfaces for receiving the top edge of a drape sample. The arm also preferably includes first and second sections which are mounted for pivotal movement with respect to each other by a vertical hinge. The drape sample, after engaging the tab and side surfaces is wrapped around the arm at least once, and the arm is mounted by a channel which receives the pivot pin(s) so that it extends generally horizontally. The arm sections are pivoted to be generally parallel to each other to display the drapery sample in a low volume configuration, and when a viewer wishes to view the drapery sample in more detail the arm is removed from the channel and then the arms are pivoted so that they are generally in line with each other, to fully display the drapery sample.

20 Claims, 4 Drawing Sheets

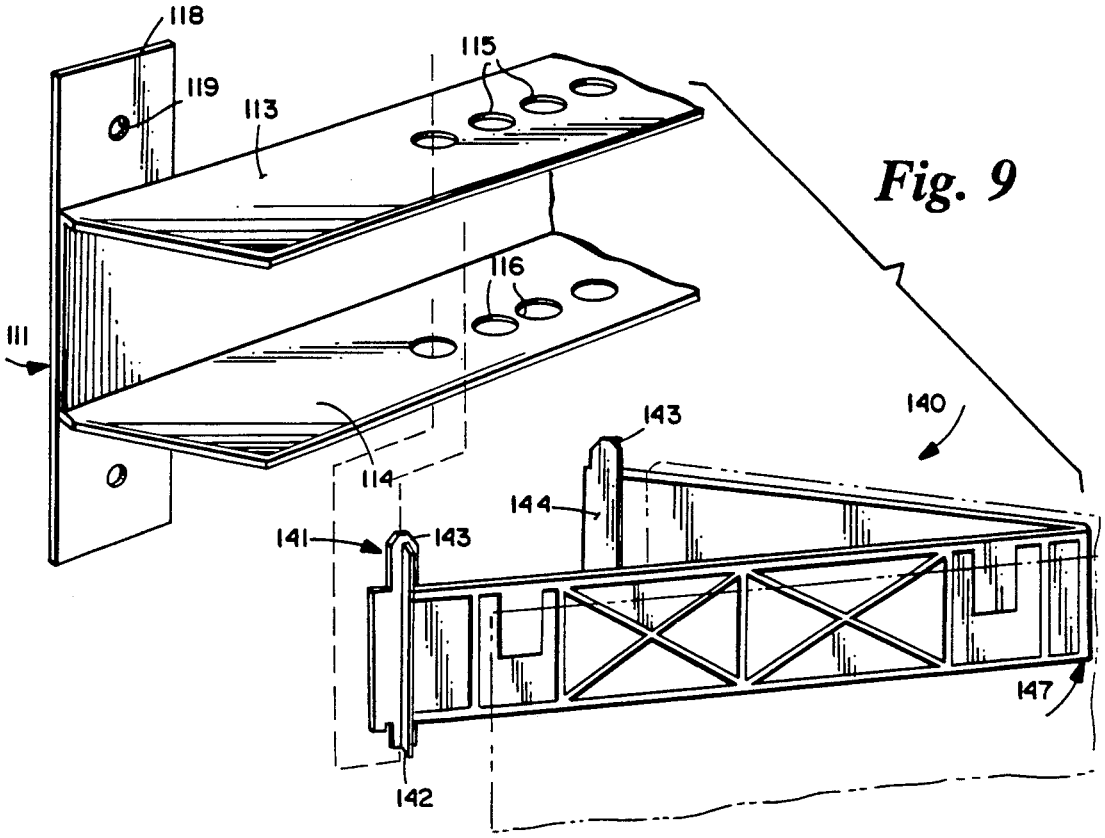
Fig. 9
Fig. 10
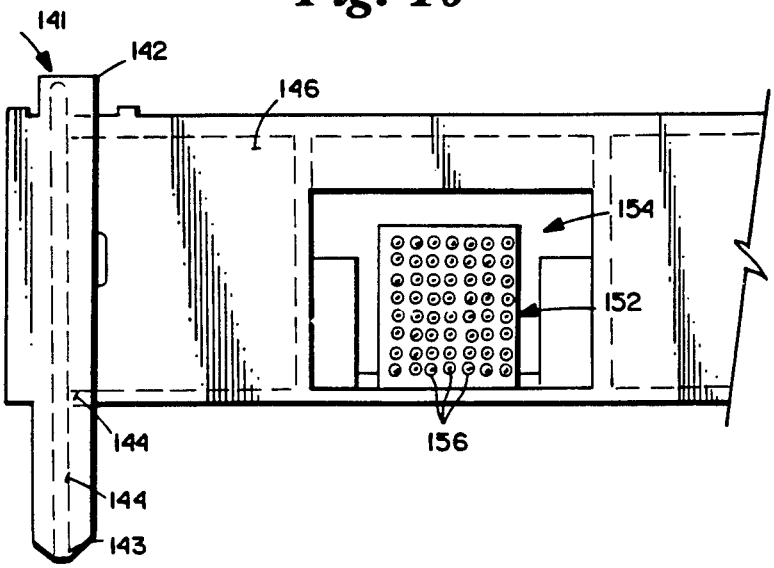

*Fig. 11*
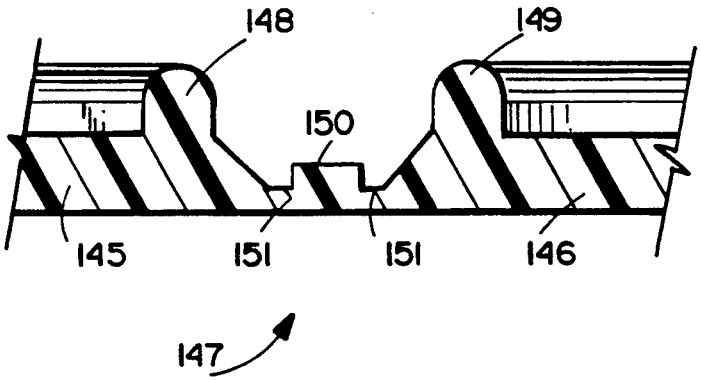
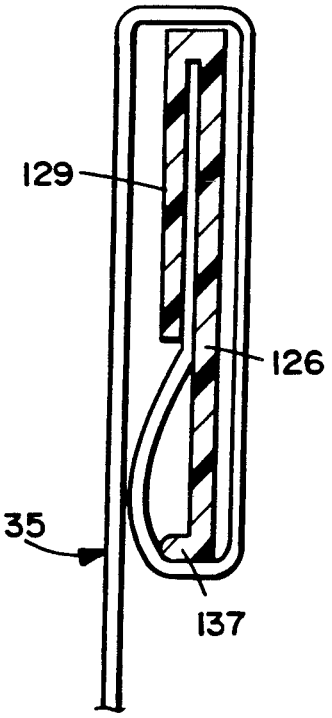
*Fig. 12*

FABRIC SAMPLE DISPLAY

BACKGROUND AND SUMMARY OF THE INVENTION

In conventional mechanical displays of drapes for sale, such as shown in U.S. Pat. No. 3,984,002, it is necessary to use a pleated fabric sample. There is a substantial cost associated with making such fabric panels, e.g. the cost is about twice as great as if the panels are not pleated. Because of the configuration of the display system, it is also difficult to provide a very large section of fabric, which can be detrimental if the fabric has a large pattern that must be featured.

According to the present invention, a display system and method for displaying a fabric sample, particularly drapery fabric samples, is provided which allows unpleated samples to be utilized, and allows the ready deployment of a large section of fabric, for example to show a large pattern. Despite these advantages, the system and method according to the invention are very simple, the system being easy to install and requiring little or no maintenance to keep it neat and attractive. Also, it is simple and easy to attach the drapery sample fabrics to the system, allowing ready removal and replacement thereof, and individual components can be detached from the system without having to detach the fabric samples from the components themselves. The system and method allow the drapery samples to be displayed in either a low volume configuration, or in a deployed configuration in which approximately twice as large a section of fabric can be displayed as in the low volume configuration.

According to one aspect of the present invention, a display for fabric samples is provided which comprises the following elements: A stationary support. A cantilever arm. The cantilever arm comprising a first section, and a second section pivotally mounted by hinge means for movement about a generally vertical axis with respect to the first section. Means for mounting the cantilever arm to the support so that the arm first section extends outwardly therefrom and generally horizontally. And, means for mounting a fabric sample to both sections of the cantilever arm so that the fabric sample may assume a low volume configuration when the second section is pivoted to a position generally parallel to the first section, or a deployed configuration when the second section is pivoted to extend substantially in line with the first section. The arm has the general shape of a rectangular plate, having length and width dimensions significantly greater than its thickness dimension. The fabric mounting means preferably comprises surface projections (such as serrations or conical projections and tabs) formed on the plate, and at least one wrap of a fabric sample around the plate. The arm is preferably made of plastic, such as molded polypropylene, and the hinge means preferably is a living hinge.

Means may be provided for releasably latching the arm first and second sections together when in the low volume configuration, or alternatively pivot pins may be provided at both ends of the arms (that is at the opposite ends of the first and second sections) which may be moved into association with a channel-shaped member having top and bottom faces and an open side face, with a series of aligned holes in the top and bottom faces. The fabric sample may be any type of fabric sample such as draperies, rugs, clothing swatches, upholstery, or the like.

According to another aspect of the present invention apparatus for displaying the drapery sample for inspection and/or sale is provided. The apparatus comprises the following elements: A sample of drapery fabric having unpleated top, bottom, and side edges. A sample-supporting cantilever arm having a generally rectangular plate configuration with first and second side faces and top and bottom edges. Means for mounting the top unpleated edge of the drapery fabric to at least one of the arm side faces. And, the drapery sample wrapping around the arm, from the mounting means, at least once so that the sample covers at least the top edge and side faces of the arm.

The invention also relates to a method of displaying a fabric for sale utilizing a cantilever arm. The method comprises the following steps: (a) Providing a fabric sample having top, bottom, and side edges. (b) Mounting the top edge of the sample in operative association with the cantilever arm. (c) Wrapping the sample around the arm at least once. And, (d) mounting the arm so that it extends generally horizontally and so that the sample hangs downwardly therefrom with the bottom edge of the sample at the bottom.

Further, the method of displaying drapery for sale utilizing a cantilever arm having first and second sections connected together by a vertical hinge, comprises the following steps: (a) Providing a drapery fabric sample having unpleated top, bottom, and side edges. (b) Mounting the top edge of the sample in operative association with both sections of the cantilever arm. (c) Mounting the arm in a mount so that it extends generally horizontally and so that the sample hangs downwardly therefrom with the bottom edge of the sample at the bottom. (d) Pivoting the arm sections with respect to each other so that they are generally parallel to display the drapery sample in a low volume configuration until a viewer wishes to view the drapery sample in more detail. And then, (e) removing the arm from the mount and pivoting the arm sections with respect to each other so that they are generally in line to fully display the drapery sample.

It is the primary object of the present invention to provide an inexpensive, simple, and effective system and method for the display of fabric samples, particularly drapery fabric samples. This and other objects of the invention will become clear from an inspection of the detailed description of the invention and from the appended claims.

BRIEF DESCRIPTION OF THE DRAWINGS

FIG. 9 is a perspective view of a portion of a modified version of the channel, and a third embodiment of cantilever arm utilizable with that channel;

FIG. 10 is a view like that of FIG. 8 only for the third embodiment;

FIG. 11 is a cross-sectional view at the hinge of the third embodiment; and

FIG. 12 is a view like that of FIG. 2 for the third embodiment, with the drape wrapped only once around the arm.

DETAILED DESCRIPTION OF THE DRAWINGS

Figure 1:
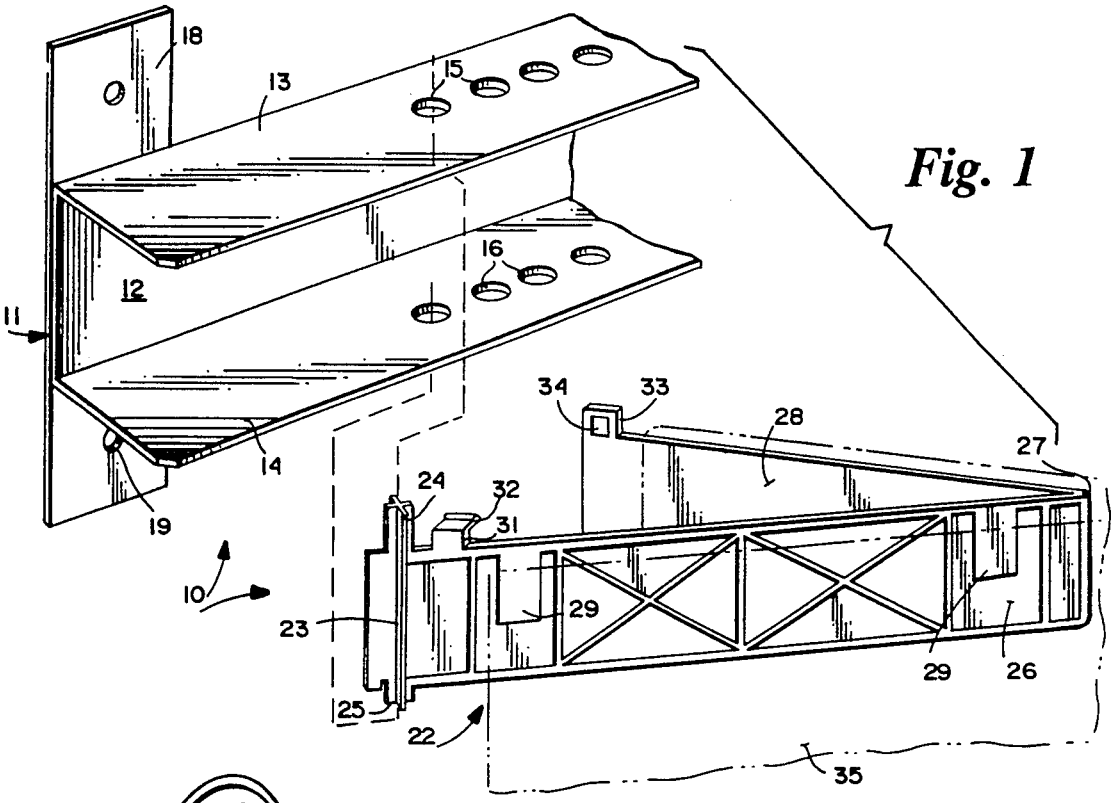
FIG. 1 is a top perspective view of a part of an exemplary stationary component, and one individual drapery sample mounting component, according to the present invention.

A display for a fabric sample, such as a drapery sample, carpet sample, upholstery sample, or the like, according to the present invention preferably comprises the elements 10 illustrated in FIG. 1. These elements include a stationary support 11 which preferably comprises a channel-shaped member having a closed side 12, a top and bottom 13, 14, and an open side opposite the closed side 12. Means for provided defining a plurality of vertically aligned holes 15, 16 in the top and bottom surfaces 13, 14, respectively. At either end of the channel is a mounting plate or bracket 18, having holes 19 therein so that fasteners (e.g. screw fasteners) may be passed through the brackets 18 to mount the stationary component 11 to a wall or other surface.

The second major component of the display 10 comprises the cantilever arm 22. The arm 22 at a first end thereof has a pivot pin 23 having portions 24 and 25 extending upwardly above the top and bottom thereof. As clearly illustrated in FIGS. 1 and 2, the cantilever arm 22 preferably has the general shape of a rectangular plate, having length and width dimensions significantly greater than its thickness dimension. For example the total length of the cantilever arm 22 may be 24 inches, with a width of two inches, and a thickness of less than two-tenths of an inch.

It is most desirable that the cantilever arm 22 comprise a first section 26 and a second section 28, which sections are interconnected by hinge means 27 for pivotally mounting the section 26, 28 together for pivotal movement about a vertical axis. While the arm 22 may be made of a variety of materials, it is preferably made of plastic, such as injection molded polypropylene, and the hinge 27 in such a situation preferably is a living hinge.

Means for provided for mounting a fabric sample to the arm 22. Such means may take the form of a plurality of tabs 29 formed on one face of the arm 22 (but on both sections 26, 28) which has an inner surface which cooperates with the outer side surface of the arm sections 26, 28 to frictionally hold the top edge of the fabric sample in place. It is also desirable that there be means for latching the arm sections 26, 28 together in a low volume configuration in which those sections are generally parallel to each other. Such latching means may comprise cooperating pieces of hook and pile fasteners ("VELCRO"), snap fasteners, or a latch arrangement as illustrated in FIG. 1. FIG. 1 illustrates a latch tab 31 extending upwardly from the arm 22 adjacent the pivot 23 thereof, with a cam portion 32 extending outwardly therefrom, and adapted to cooperate with a latch projection 33 having an opening 34 therein at the opposite end of the arm 22. The latch may be easily released and easily closed.

Of course the pivot pin 23 provides means for mounting the cantilever arm 22 to the stationary support 11 so that the arm first section 26 extends generally vertically outwardly from the stationary support 11, and generally horizontally. The pivot pin portions 24, 25 are brought into operative association with the aligned holes 15, 16 of one set of holes in the series of holes. Such an arrangement allows for positive location of the cantilever arm 22 in place, and pivotal movement thereof, yet allows the entire arm 22 (with fabric sample attached) to be readily detached. For example this is accomplished merely by pushing upwardly on the arm 22 so that the pivot portion 25 clears the bottom plate 14, and then tilting the arm 22 to remove it from the channel defined by the elements 12 through 14. The pivot pin portion 24 has sufficient length to allow this while still positively retaining the arm 22 in place when desired.

Figure 2:
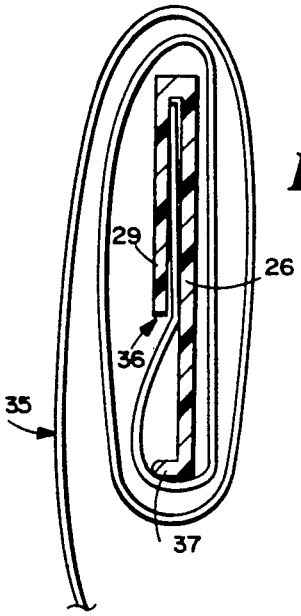
FIG. 2 is a side view, partly in cross-section and partly in elevation, of the cantilever arm of the apparatus of FIG. 1 with the drapery sample shown in operative association therewith.
Figure 3:
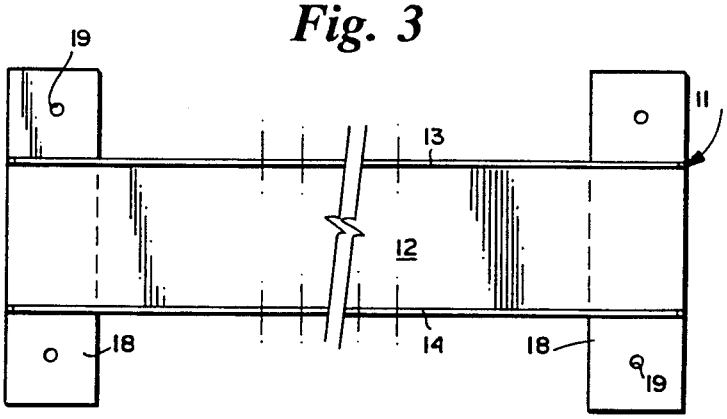
FIG. 3 is a side view of the stationary component of the apparatus of FIG. 1.
Figure 4:
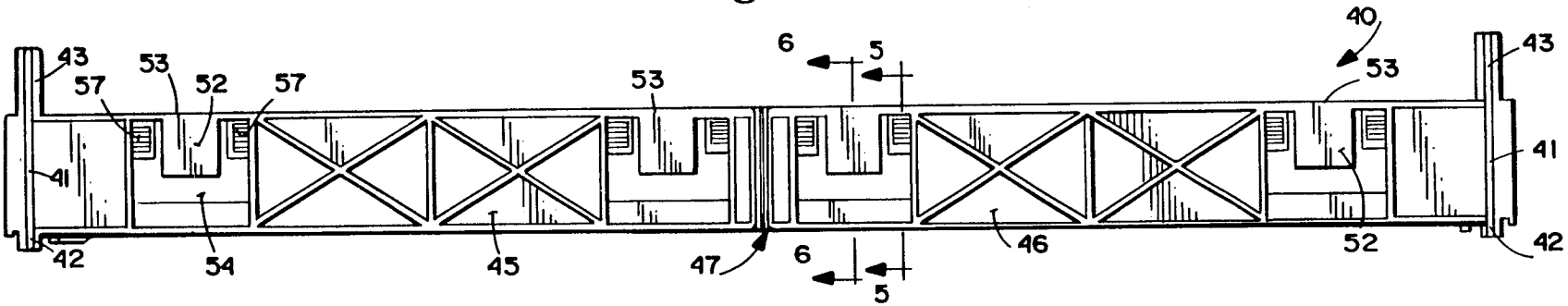
FIG. 4 is a side view of a second embodiment of cantilever arm utilizable with the channel of FIG. 3.
Figure 8:
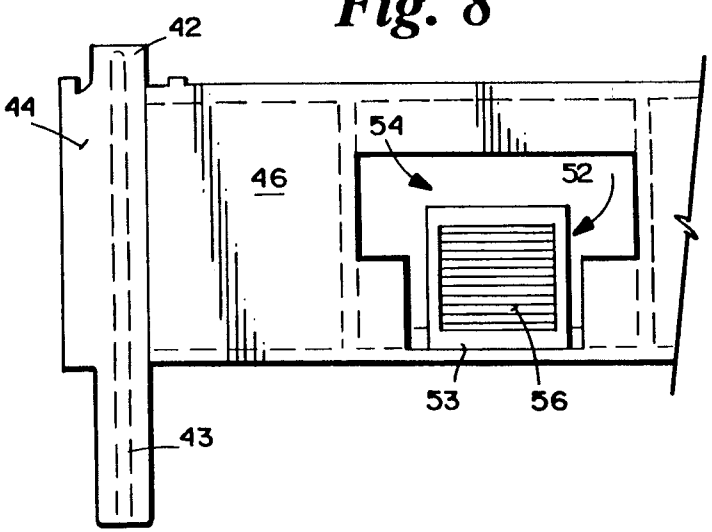
FIG. 8 is a side detail view of the opposite face of one end of the arm of FIG. 4.
Figure 7:
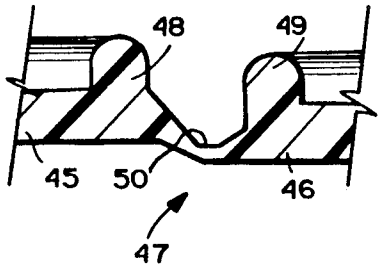
FIG. 7 is a detail cross-sectional view taken at the living hinge of the arm of FIG. 4.
Figure 6:
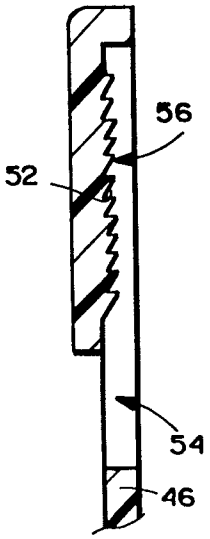
FIGS. 5 and 6 are cross-sectional views taken along lines 5—5 and 6—6 of FIG. 4, respectively.
Figure 5:
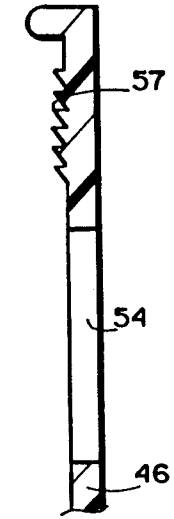

FIGS. 1 and 2 also show the fabric sample 35 (shown in dotted line in FIG. 1 and solid line in FIG. 2) in operative association with the arm 22. The fabric sample is disposed in operative association with both the sections 26, 28 of the arm 22. The top edge 36 of the fabric sample is moved into cooperative association with the tabs 29—as earlier described—and then preferably the fabric sample 35 is wrapped around the arm 22 at least once. For example as illustrated in FIG. 2, the fabric sample first moves downwardly past the projection 37, and then around the top and bottom edges of the arm, and the side faces thereof. As illustrated in FIG. 2, the drapery sample 35 has been wrapped around the arm 22 twice; however it also could be wrapped as illustrated in FIG. 12.

FIGS. 4 through 8 illustrate another embodiment of cantilever arm that may be utilized with the stationary support 11 according to the invention. The arm in the FIGS. 4 through 8 embodiment is illustrated generally by reference numeral 40. At each of the ends of the arm 40 are provided pivot pins 41, each of which has a downwardly extending relatively short portion 42 and an upwardly extending relatively long portion 43. The "back" ends of the pins 41 are flat—see surfaces 44—so that the two pins 41 of each arm 40 have the surfaces 44 back to back when inserted in holes 15, 16. The arm 40 includes first and second sections 45, 46 which are connected together by a vertical hinge, e.g. a living hinge 47. The arm 40 also preferably is made of plastic such as injection molded polypropylene. At the living hinge 47, raised projections 48, 49 are provided on the sections 45, 46, respectively, with a thin integral piece of plastic 50 connecting the sections 45, 46.

The means associated with the arm 40 for holding the drapery sample in place include the tabs 52 extending downwardly from the top edge 53 of the arm 40, the arm 40 preferably having a cut out opening 54 adjacent each tab 52. Tab 52 comprises a surface manifestation of the arm 40 for facilitating holding of a drapery sample, and preferably itself has its own surface manifestations—e.g. serrations illustrated by reference numeral 56 in FIG. 6. Mounted on either side of the tab 52 at the face of the arm 40 there preferably are other surface manifestations such as serrations 57. The top edge of a drapery fabric sample, thus, would be held by the tabs 52 (engaging serrations 56 thereof), and at each tab 52 also would be in contact with the serrations 57 straddling the tab 52. With this embodiment, as with the FIGS. 1 and 2 embodiment, the drapery sample preferably is wrapped at least once around the arm 40.

For the FIGS. 4 through 8 embodiment, when the arm 40 is in the fully displaying position (FIG. 4), preferably it has been completely removed from channel 11; alternatively, only one of the hinge pins 41 can be in operative association with the stationary structure 11. When it is in a low volume configuration, then the arm sections 45, 46 are pivoted with respect to each other so that they become generally parallel, with surfaces 44 back to back, and the pivot pins 41 are placed in operative association with one set of aligned openings 15, 16, in stationary support 11 (although one pin 41 may be placed in the next set of openings in the series, if desired).

Note that in both embodiments the hinge means 27, 47 are illustrated at approximately the middle of the length of the arms 22, 40. However the hinge means may be at other positions along the arm, and more than one vertical hinge means may be provided on a given arm. Also for the FIG. 4 embodiment, in the fully deployed position under some circumstances one could mount the second pivot pin 41 in association with another vertical support, although this normally would not be desirable.

One of the significant advantages of the invention is the ability to display a drapery sample that is unpleated, which results in the savings in manufacturing samples of approximately 50% compared to a pleated drapery sample. Also, the ability to display the drapery in a relatively low volume configuration (e.g. FIG. 1, with the arm sections 26, 28 generally parallel) to conserve space, but allowing a much larger section of the fabric to be displayed if the viewer has a particular interest in one sample (as by moving the arms 26, 28 in a generally in-line configuration, as shown for the arm 40 in FIG. 4, and detaching it from channel 11), is significant.

According to the method of the present invention, a drapery is displayed for sale. This is preferably accomplished by providing a drapery fabric sample having unpleated top, bottom, and side edges. Then the top edge is mounted in operative association with the cantilever arm, as by moving the top edge 36 of the drapery sample 35 between the tabs 29 and the side face of the arm sections 26, 28. Then the fabric sample is wrapped around the arm 22 at least once (see FIGS. 2 and 12), and the arm 22 is mounted by the hinge pin 23 so that it extends generally horizontally and so that the sample 35 hangs downwardly therefrom with the bottom edge of the sample at the bottom.

The method also comprises the steps of pivoting the arm sections 26, 28 with respect to each other so that they are generally parallel to display the drapery sample in a low volume configuration (FIG. 1 after the latch sections 31 through 34 are moved together) until a viewer wishes to view the drapery sample 35 in more detail. Then the latch 31–34 is unlatched, and the arm sections 26, 28 are pivoted with respect to each other about the hinge 27 so that they are generally in line (as illustrated for the arm 40 in FIG. 4) to fully display the drapery sample 35. The entire arm 22 can be easily removed from the support 11 merely by moving it upward to clear pivot portion 25, and then pulling and tilting it outwardly.

In the third embodiment of FIGS. 9 through 12, there are a few structural changes from the second embodiment of FIGS. 4 through 8, however all the components still operate in a similar manner. In the FIGS. 9 through 12 embodiment generally the same structures as those illustrated in the FIGS. 4 through 8 embodiment are indicated by the same reference numeral only preceded by a "1".

Channel 111 illustrated in FIG. 9 is basically the same as the channel 11 except that the chamfer is greatly increased, and the size of the openings 115, 116 in top and bottom surfaces 113, 114 are increased slightly. The arm 140 is also basically the same as the arm 40, except that the pivot pins 141 are slightly longer. Also, although not illustrated in the drawings, if desired the sections 145, 146 can be held together, generally parallel, by any suitable conventional latching means, such as a slot in the back on one section 145, 146, and a small rectangular peg on the other.

The hinge 147 also has a slightly different construction than the hinge 47. There is an intermediate thickened web portion 150 with smaller web portions 151 on opposite sides thereof, forming the "living hinge" 147. Further, instead of serrations being provided to assist in holding the drapery in engagement with tab 152, etc., small conical projections 156 (see FIG. 10) may be provided.

The third embodiment functions in the same manner as the second embodiment. That is, in the "low volume" configuration when the arms 145, 146 are generally parallel to each other and the surfaces 144 of the pivot pins 141 are back to back, the pin extensions 142, 143 of both pins 141 are received in the same openings 115, 116. When it is desired to view the drapery sample 35, one removes the entire arm 140 from the openings 115, 116, and folds the sections 145, 146 outwardly to a deployed configuration.

It will thus be seen that according to the present invention a simple, inexpensive, yet effective display system and method have been provided for the display of fabric samples, particularly for drapery fabric samples. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent systems and methods.

What is claimed is:

1. A display for fabric samples, comprising:

(a) a stationary support;

(b) a cantilever arm;

(c) said cantilever arm comprising a first section, and a second section pivotally mounted by hinge means for movement about a generally vertical axis with respect to said first section;

(d) means for mounting said cantilever arm to said support so that said arm first section extends outwardly therefrom and generally horizontally; and (e) means for mounting a fabric sample to both sections of said cantilever arm so that said fabric sample may assume a low volume configuration when said second section is pivoted to a position generally parallel to said first section, or a deployed configuration when said second section is pivoted to extend substantially in line with said first section.

2. A display as recited in claim 1 wherein said arm has the general shape of a rectangular plate, having length and width dimensions significantly greater than its thickness dimension; and wherein said means (e) comprises surface projections formed on said plate, and at least one wrap of a fabric sample around said plate.

3. A display as recited in claim 2 wherein said hinge means comprises a living hinge.

4. A display as recited in claim 2 wherein said arm is made of plastic.

5. A display as recited in claim 4 wherein said plastic is polypropylene.

6. A display as recited in claim 1 further comprising means for releasably latching said arm first and second sections together when in said low volume configuration.

7. A display as recited in claim 1 wherein said means (a) comprises a channel shaped member having top and bottom faces and an open side face, and means defining a series of aligned holes in said top and bottom faces.

8. A display as recited in claim 7 wherein said means (d) comprises pivot pin portions extending both upwardly and downwardly from an end of said first section of said arm, one pivot pin portion for receipt by one of the aligned holes in each of said channel top and bottom faces.

9. A display as recited in claim 7 further comprising pivot pin portions extending both upwardly and downwardly from both ends of said arm, said pivot pin portions having flat back portions for cooperating so that when said pivot pin portions are in back to back configuration they are collectively received by one of the aligned holes in each of said channel top and bottom faces.

10. A display as recited in claim 2 wherein said surface projections comprises a tab portion having a first surface and body portions defining a second surface parallel to but spaced from said first surface, said body portions straddling said tab portion, the fabric sample adapted to be received between said surfaces.

11. A display as recited in claim 10 wherein conical projections are provided on said first and second surfaces.

12. A display as recited in claim 2 wherein said means (a) comprises a channel shaped member having top and bottom faces and an open side face, and means defining a series of aligned holes in said top and bottom faces and wherein said means (d) comprises pivot pin portions extending both upwardly and downwardly from at least one end of said cantilever arm for receipt by one of the aligned holes in each of said channel top and bottom faces, the pivot pin portion extending downwardly being shorter than the one extending upwardly.

13. Apparatus displaying a drapery sample for inspection and/or sale, comprising:

a sample of drapery fabric having unpleated top, bottom, and side edges;

a sample-supporting cantilever arm having a generally rectangular plate configuration with first and second side faces and top and bottom edges;

means for mounting the top unpleated edge of said drapery fabric to at least one of said arm side faces; and the drapery sample wrapping around said arm, from said mounting means, at least once so that said sample covers at least the top edge and side faces of said arm.

14. Apparatus as recited in claim 13 further comprising means for mounting said cantilever arm for pivotal movement about a generally vertical axis.

15. Apparatus as recited in claim I3 wherein said arm comprises a first section, and a second section, with hinge means between said first and second sections for allowing pivotal movement of one section with respect to the other about a vertical axis.

16. Apparatus as recited in claim 13 wherein said cantilever arm has first and second ends, and wherein at each end a pivot pin is provided extending above the top edge of said arm and below the bottom edge thereof.

17. Apparatus as recited in claim 15 wherein said cantilever arm has first and second ends, a pivot pin provided at said first end and having portions thereof extending above said arm top edge and below said arm bottom edge; and further comprising latch means for latching said first section to said second section, said latch means being located adjacent, but spaced from, said pivot pin, at said first end of said arm, and adjacent said second end of said arm.

18. A method of displaying a fabric for sale, utilizing a cantilever arm, comprising the steps of:

(a) providing a fabric sample having top, bottom, and side edges;

(b) mounting the top edge of the sample in operative association with the cantilever arm;

(c) wrapping the sample around the arm at least once; and (d) mounting the arm in a mount so that it extends generally horizontally and so that the sample hangs downwardly therefrom with the bottom edge of the sample at the bottom.

19. A method as recited in claim 18 wherein the cantilever arm has first and second sections connected together by a vertical hinge, and comprising the further steps of:

pivoting the arm sections with respect to each other so that they are generally parallel to display the fabric sample in a low volume configuration until a viewer wishes to view the fabric sample in more detail; and then removing the arm from the mount and pivoting the arm sections with respect to each other so that they are generally in line to fully display the fabric sample.

20. A method of displaying a drapery for sale, utilizing a cantilever arm having first and second sections connected together by a vertical hinge, comprising the steps of:

(a) providing a drapery fabric sample having unpleated top, bottom, and side edges;

(b) mounting the top edge of the sample in operative association with both sections of the cantilever arm;

(c) mounting the arm in a mount so that it extends generally horizontally and so that the sample hangs downwardly therefrom with the bottom edge of the sample at the bottom;

(d) pivoting the arm sections with respect to each other so that they are generally parallel to display the drapery sample in a low volume configuration until a viewer wishes to view the drapery sample in more detail; and then (e) removing the arm from the mount and pivoting the arm sections with respect to each other so that they are generally in line to fully display the drapery sample.

* * * * *